US011472593B1

(12) United States Patent
Bley et al.

(10) Patent No.: US 11,472,593 B1
(45) Date of Patent: Oct. 18, 2022

(54) AUTO-LOCKING AND TAMPER EVIDENT CONTAINER

(71) Applicant: Packaging Corporation of America, Lake Forest, IL (US)

(72) Inventors: Robert W. Bley, Long Valley, NJ (US); Jordan A. Saracena, Montclair, NJ (US)

( * ) Notice: Subject to any disclaimer, the term of this patent is extended or adjusted under 35 U.S.C. 154(b) by 146 days.

(21) Appl. No.: 17/003,786

(22) Filed: Aug. 26, 2020

Related U.S. Application Data

(60) Provisional application No. 62/893,349, filed on Aug. 29, 2019.

(51) Int. Cl.
*B65D 5/02* (2006.01)
*B65D 5/66* (2006.01)

(52) U.S. Cl.
CPC ..... *B65D 5/0254* (2013.01); *B65D 5/6608* (2013.01); *B65D 2401/10* (2020.05)

(58) Field of Classification Search
CPC B65D 5/0254; B65D 5/6608; B65D 2401/10; B65D 5/6664; B65D 2401/15; B65D 2401/00
USPC ..... 229/102, 149, 146, 148, 178, 228, 229/117.24, 153; 206/807
See application file for complete search history.

(56) References Cited

U.S. PATENT DOCUMENTS 2,369,385 A 2/1945 Carruth et al.
2,396,310 A 3/1946 Yungblut
2,906,444 A 9/1959 Weiss et al.
2,963,214 A 12/1960 Leone, Jr. et al.
3,073,501 A 1/1963 Williamson
3,078,030 A 2/1963 Gorton
3,125,280 A 3/1964 Henry
3,191,848 A 6/1965 Meyers
3,206,102 A 9/1965 Henry et al.
3,233,818 A * 2/1966 Bixler ..... B65D 5/703 229/117.34
3,283,991 A 11/1966 Hughes
3,294,309 A 12/1966 Coe
3,310,222 A 3/1967 Buttery
3,338,505 A 8/1967 Hughes
RE26,471 E 10/1968 Meyers
3,543,995 A 12/1970 Wilson
3,642,193 A * 2/1972 Rada ..... B65D 5/30 229/149

(Continued)

FOREIGN PATENT DOCUMENTS

IN 201721025319 A 1/2019
WO WO 2011/071774 6/2011

*Primary Examiner* — Christopher R Demeree
(74) *Attorney, Agent, or Firm* — Klarquist Sparkman, LLP

(57) ABSTRACT

A container can include a main body and a lid. The main body can include a first panel having a receptacle formed therein and a second panel having a perforated tab. The lid is pivotably coupled to the main body and includes a locking tab. The container can be locked in a closed configuration by inserting the locking tab of the lid into the receptacle of the main body. The perforated tab of the main body retains the locking tab of the lid within the receptacle of the main body when the perforated tab is in a first position relative to the second panel. The container can be unlocked by moving the perforated tab from the first position to a second position relative to the second panel and by removing the locking tab of the lid from the receptacle of the main body.

20 Claims, 9 Drawing Sheets

(56) References Cited

U.S. PATENT DOCUMENTS 3,900,158 A 8/1975 Berkhouse
4,113,104 A 9/1978 Meyers
4,141,449 A 2/1979 Stone
4,252,267 A * 2/1981 Osborne ..... B65D 5/304 229/149
4,284,197 A 8/1981 Meyers
4,310,093 A 1/1982 Manser
4,314,643 A 2/1982 Forbes, Jr.
4,688,677 A 8/1987 Roccaforte
4,863,035 A 9/1989 Hiroshima
4,964,561 A 10/1990 Whelan
5,203,495 A 4/1993 Jorgensen-Beck et al.
5,236,122 A * 8/1993 Ballard ..... B65D 5/30 229/173
5,314,114 A 5/1994 Stone
5,318,218 A * 6/1994 Mattson ..... B65D 5/4604 229/125.21
5,350,108 A 9/1994 Friar et al.
5,373,960 A 12/1994 Gunn et al.
5,505,374 A 4/1996 Stone
5,507,428 A 4/1996 Robinson, Jr. et al.
5,515,996 A 5/1996 Stone
5,553,773 A 9/1996 Focke et al.
5,803,345 A 9/1998 Jones et al.
5,878,948 A 3/1999 Schultz
5,975,415 A * 11/1999 Zehnal ..... B65D 5/541 206/815
6,296,175 B1 * 10/2001 Dixon ..... B65D 5/685 229/102
6,948,616 B2 * 9/2005 Gillani ..... B65D 5/46024 206/459.5
7,669,755 B2 3/2010 Smalley
8,408,451 B2 8/2013 Adam et al.
9,481,486 B2 11/2016 Nameth et al.
10,189,625 B2 1/2019 Bressan
10,358,254 B2 6/2019 Buss
10,370,140 B2 8/2019 Bressan et al.
10,450,101 B2 10/2019 Bressan et al.
10,875,677 B2 * 12/2020 Davis ..... B65D 5/0254
11,040,797 B2 * 6/2021 Zeiler ..... B65D 5/106
2007/0108263 A1 5/2007 Nash
2009/0001145 A1 1/2009 Hasse et al.
2011/0253776 A1 10/2011 Craft et al.
2018/0170635 A1 6/2018 Bressan et al.
2018/0273238 A1 * 9/2018 Wagner ..... B65D 5/6652
2019/0100346 A1 4/2019 Bressan et al.
2019/0329930 A1 10/2019 Davis
2020/0017254 A1 1/2020 Zeiler
2020/0031545 A1 1/2020 Bressan et al.
2021/0292040 A1 * 9/2021 Zeiler ..... B65D 5/6664
2021/0371153 A1 * 12/2021 Borst, Sr. ..... B65D 5/0254

* cited by examiner

AUTO-LOCKING AND TAMPER EVIDENT CONTAINER

CROSS-REFERENCE TO RELATED APPLICATION

This application claims priority to U.S. Provisional Application No. 62/893,349, filed on Aug. 29, 2019, which is incorporated by reference herein.

FIELD

This disclosure relates generally to containers, including containers for use as delivery packages and methods of manufacturing such containers.

BACKGROUND

Typical packaging containers (e.g., boxes) can be opened, tampered with, and resealed without much effort and without the intended recipient of the package knowing whether there was any tampering. As such, typical containers are not well suited for goods that are sensitive (e.g., confidential) and/or where authenticity and/or quality are important. Thus, there is a need for improved containers.

SUMMARY

Disclosed herein are examples of containers that can provide a secure package that automatically locks upon initial closure and provides irreversible evidence of tampering when the container is opened.

In one representative embodiment, a container can comprise a main body portion and a lid portion. The main body portion comprises a plurality of panels, including a first panel comprising a receptacle formed therein and a second panel comprising a perforated tab. The lid portion is pivotably coupled to the main body portion and comprises a locking tab. The container can be locked in a closed configuration by inserting the locking tab of the lid portion into the receptacle of the main body portion. The perforated tab of the main body portion retains the locking tab of the lid portion within the receptacle of the main body portion when the perforated tab is in a first position relative to the second panel. The container can be unlocked by moving the perforated tab from the first position to a second position relative to the second panel and by removing the locking tab of the lid portion from the receptacle of the main body portion.

In some embodiments, the locking tab and the second panel are at least substantially coplanar when the container is in the closed configuration.

In some embodiments, the main body portion further comprises a third panel, and the first panel is disposed between the second panel and the third panel.

In some embodiments, the first panel is an intermediate panel, the second panel is an outer panel, and the third panel is an inner panel.

In some embodiments, the locking tab comprises one or more first edge surfaces, the first panel comprises one or more second edge surfaces defining the receptacle, and the one or more first edge surfaces engage with the one or more second edge surfaces to retain the container in the closed configuration.

In some embodiments, the one or more first edge surfaces abut with the one or more second edge surfaces.

In some embodiments, the locking tab is pivotably coupled to a flap of the lid portion, and wherein the locking tab overlaps the flap when the container is locked in the closed configuration.

In some embodiments, when the perforated tab is moved from the first position to the second position, the locking tab pivots away from the flap such that the locking tab and the flap do not overlap.

In some embodiments, the main body portion and the lid portion are integrally formed.

In some embodiments, the container comprises cardboard.

In another representative embodiment, a box comprises a main body portion and a lid portion pivotably coupled to the main body portion. The main body portion comprising a plurality of panels. A first panel of the plurality of panels comprises a receptacle formed therein, and a second panel of the plurality of panels comprises a perforated tab. The lid portion comprises a locking tab. The box can be locked in a closed configuration by inserting the locking tab of the lid portion into the receptacle of the main body portion. The perforated tab of the main body portion retains the locking tab of the lid portion within the receptacle of the main body portion when the perforated tab is in a first position relative to the second panel. The box can be unlocked by moving the perforated tab from the first position to a second position relative to the second panel. Moving the perforated tab to the second position can provide irreversible evidence of tampering.

In some embodiments, moving the perforated tab from the first position to the second position relative to the second panel comprises tearing the perforated tab along one or more perforation lines, and the torn perforated tab provides the irreversible evidence of tampering.

In some embodiments, the box comprises cardboard.

The various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosure will become more apparent from the following detailed description, claims, and accompanying figures.

DETAILED DESCRIPTION

General Considerations

Figure 1:
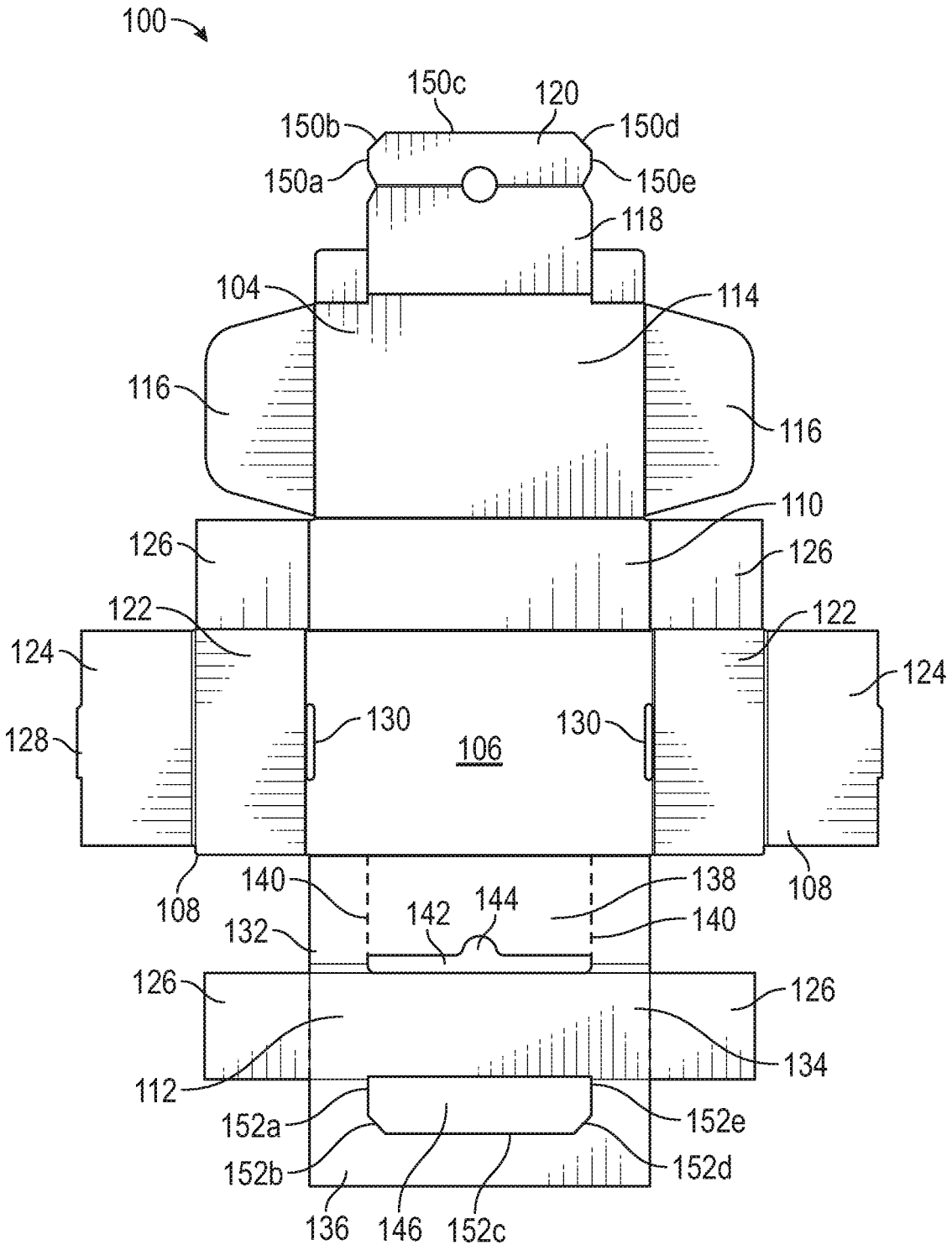
FIG. 1 is a plan view of an exemplary container, showing the container in a flat configuration (which can also be referred to as a "blank").

As used in this application the singular forms "a," "an," and "the" include the plural forms unless the context clearly dictates otherwise. Additionally, the term "includes" means "comprises." Furthermore, as used herein, the term "and/or" means any one item or combination of items in the phrase. In addition, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the term "box" and "container" refer to an article that is capable of holding one or more products or other physical articles. As used herein, the term "cardboard box" refers to a box formed from any of a variety of heavy paper-like materials, including, for example, cardstock, corrugated fiberboard, and/or paperboard. As used herein, the term "corrugated fiberboard" refers to a fluted corrugated medium with one or more flat liner boards coupled thereto, such as a central corrugated layer with a first liner board on one side and a second liner board on another side of the central corrugated layer.

As used herein, the term "blank" refers to a flat sheet of material that is formed into a container, such as a flat sheet of corrugated paperboard. As used herein, the term "flat-formed" refers to an article that is manufactured from one or more flat pieces, such as a blank, that are manipulated into a different shape, such as by folding. As used herein, the term "hingedly coupled" refers to any manner of engagement between a first part of a blank relative to a second part of the blank which allows the first part to travel relative to the second part without the first part becoming disengaged from the second part, such as by one or more fold lines, one or more cut lines, and/or some combination thereof. As used herein, the term "cut line" refers to an area that includes a cut that extends at least partially through the blank to facilitate folding, tearing, and/or some other structural advantage. Cut lines can be straight, curved, or some other shape, and can include perforation lines in which the cut is not continuous along the length of the cut line (i.e., a perforated line is a cut line that is discontinuous).

As used herein, the terms "graphic" and "graphical element" refer to any visual design elements including, but not limited to, photos, logos, text, illustrations, instructions, advertisements, lines, shapes, patterns, and/or images of various kinds, as well as any combinations of these elements. The terms graphic and graphical element are not intended to be limiting and can incorporate any number of contiguous or non-contiguous visual features. A graphic can be applied to a surface of a material, such as a blank, in any suitable manner. For example, a graphic can be provided on a surface by printing, lamination, adhesive application, coating application (e.g., paint), embossing, and/or any other means.

For the purposes of this disclosure, relative terms such as "vertical", "horizontal", "top", "bottom", "front", "back", "end" and "sides" may be used. It should be understood, however, that the terms are used only for purposes of description, and are not intended to be used as limitations. Accordingly, the orientation of an object or a combination of objects may change without altering the scope of the claimed subject matter.

Exemplary Containers and Methods of Constructing

Disclosed herein are examples of containers that can provide a secure package that automatically locks upon initial closure and provides irreversible evidence of tampering when the container is opened. The disclosed container can also be reclosed after they are initially opened. These containers provide one or more advantages of prior containers. For example, the disclosed containers can provide improved security due to the locking and tamper evidence features compared to typical packing products. The disclosed containers are also simple and easy to assemble and use.

FIG. 1 shows a container 100 in a flat configuration. In the configuration, the container 100 can also be referred to as "the blank 100." The blank 100 can comprise a one-piece, unitary construction in which each of the walls, extension portions, tabs, fold lines, etc., are integrally formed with the blank. As used herein, the terms "unitary construction" and "integrally formed" refer to a construction that does not include any welds, fasteners, or other means for securing separately formed pieces of material to each other. In other embodiments, any of the various panels, extension portions, tabs, etc., can be separately formed and secured to the main body of the box (e.g., with adhesive, fasteners, and/or other securing means).

The container 100 can be formed of various cardboard and/or paper products. The box configurations described herein can also be made from polymeric materials. In certain embodiments, each of the cuts, fold lines, score lines, etc., of the blank 100 can be formed in an in-line, streamlined manufacturing process such that the blank can be produced without requiring that the production equipment be stopped.

The blank 100 shown in FIG. 1 can have various fold lines (i.e., shown as "green" lines) and/or perforations (i.e., shown as "dashed" lines). The blank 100 can be folded along the fold lines to produce a three-dimensional container. The perforations can aid folding in certain directions and/or allow a portion of the container 100 to be removed (e.g., torn off without the use of a cutting tool).

Figure 2:
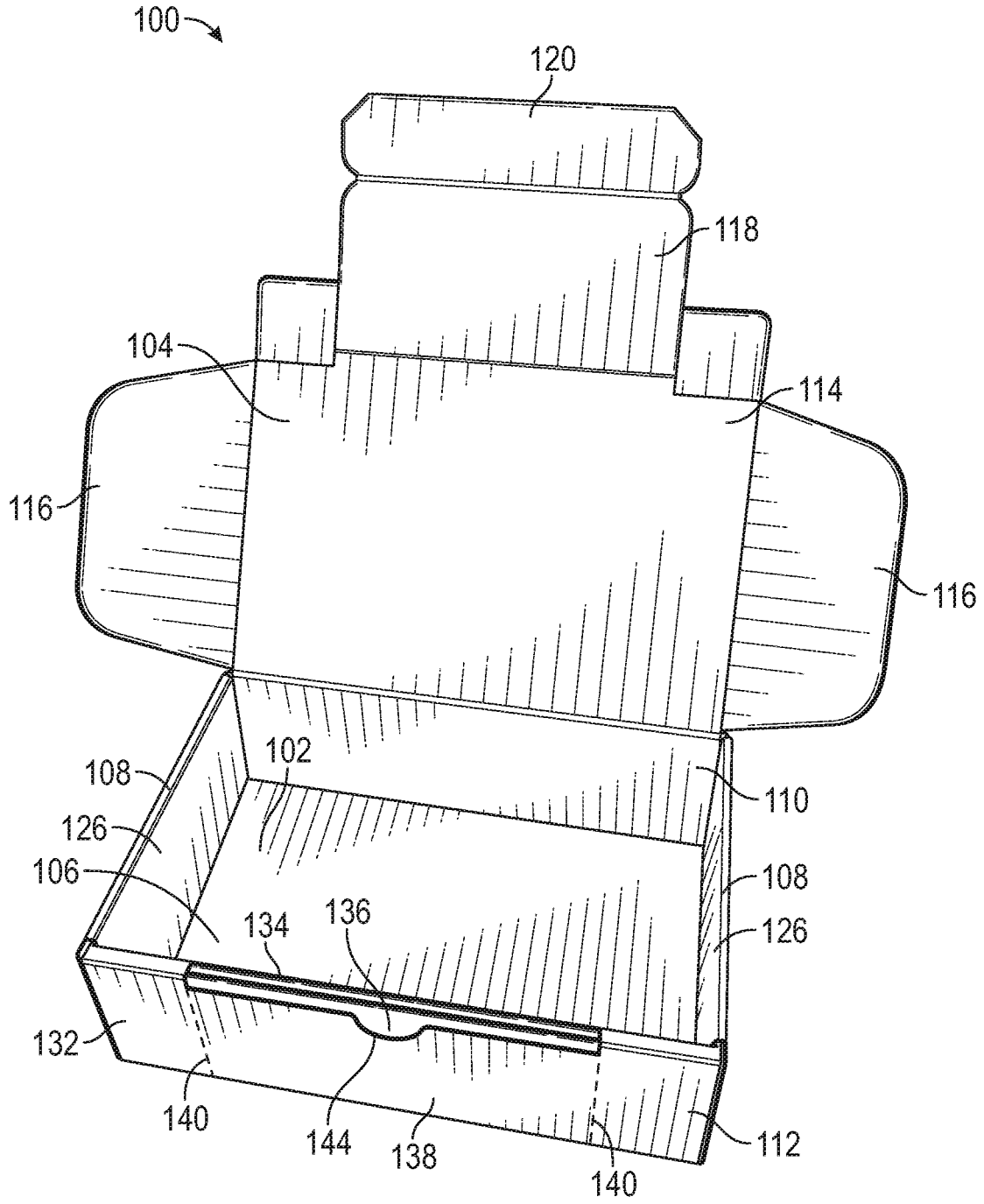
FIG. 2 is a perspective view of the container of FIG. 1, showing the container in an initial open configuration.
Figure 5:
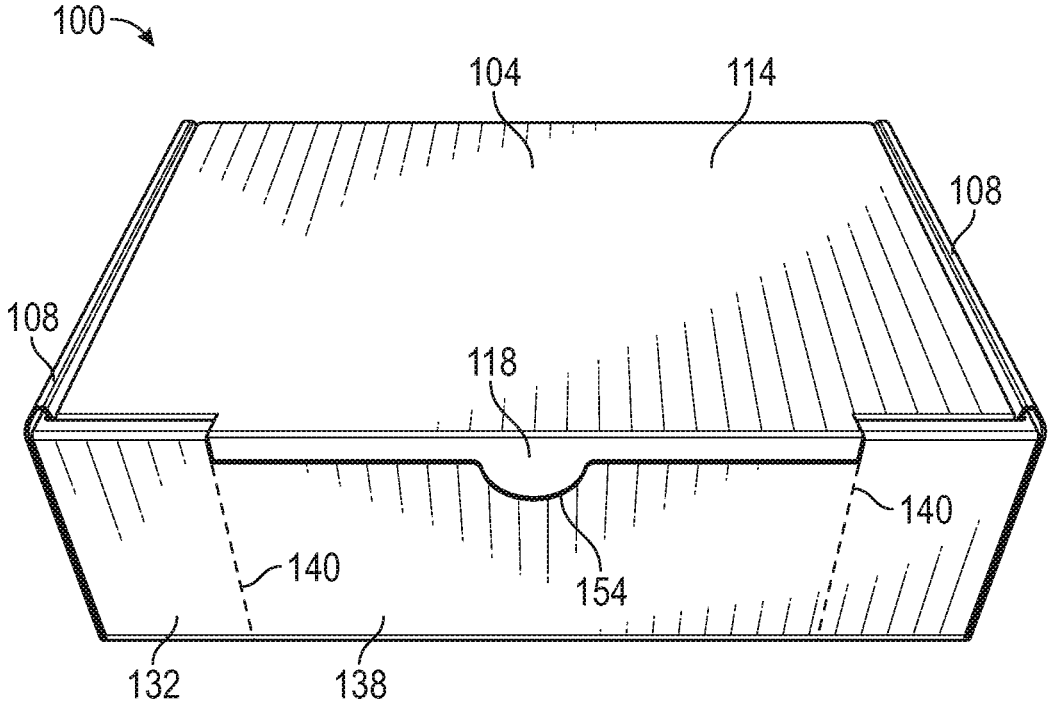
FIG. 5 is a perspective view of the container of FIG. 1, showing the container in the closed and locked configuration.
Figure 7:
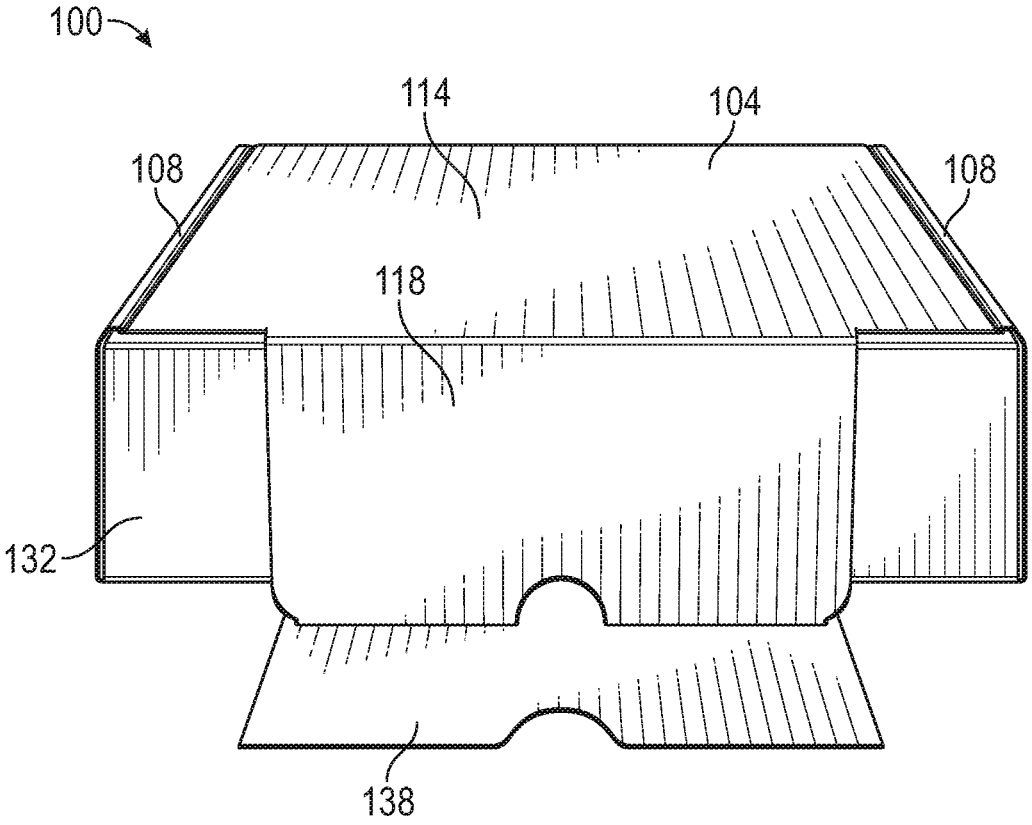
FIG. 7 is a perspective view of the container of FIG. 1, showing the container in the closed and unlocked configuration.
Figure 8:
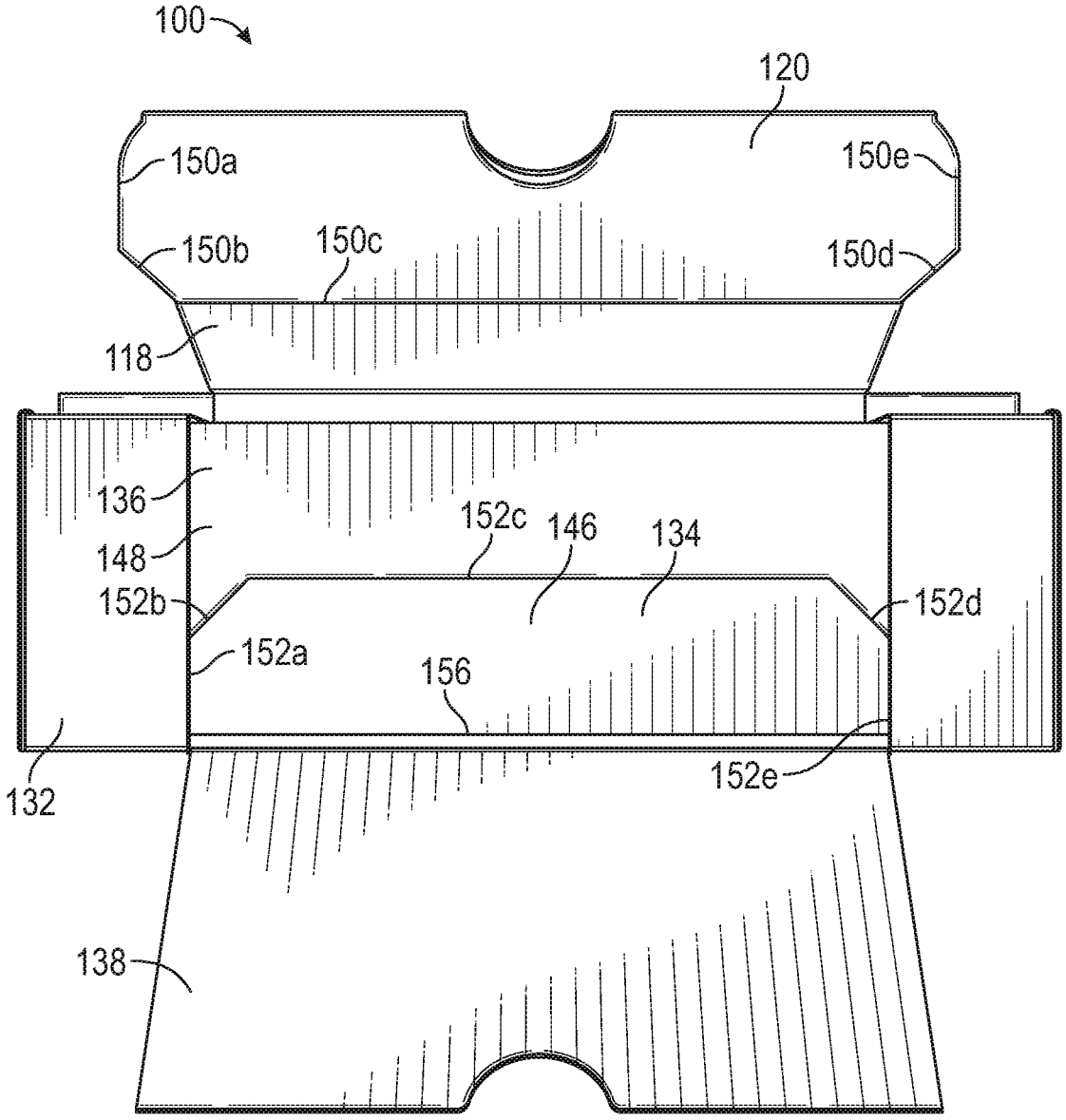
FIG. 8 is a perspective view of the container of FIG. 1, showing the container moving from the closed and unlocked configuration to an open configuration.
Figure 9:
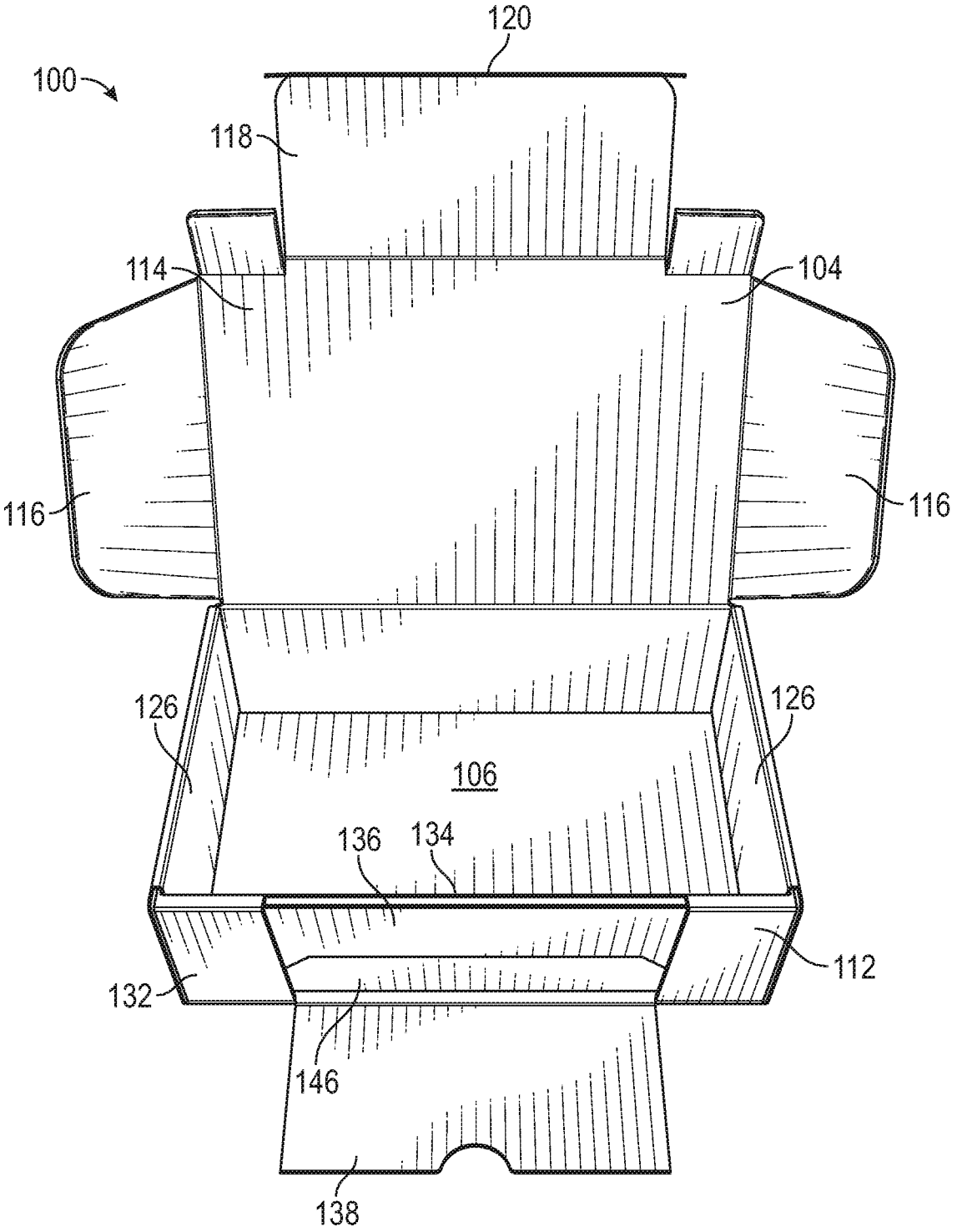
FIG. 9 is a perspective view of the container of FIG. 1, showing the container in a reopened configuration.
Figure 10:
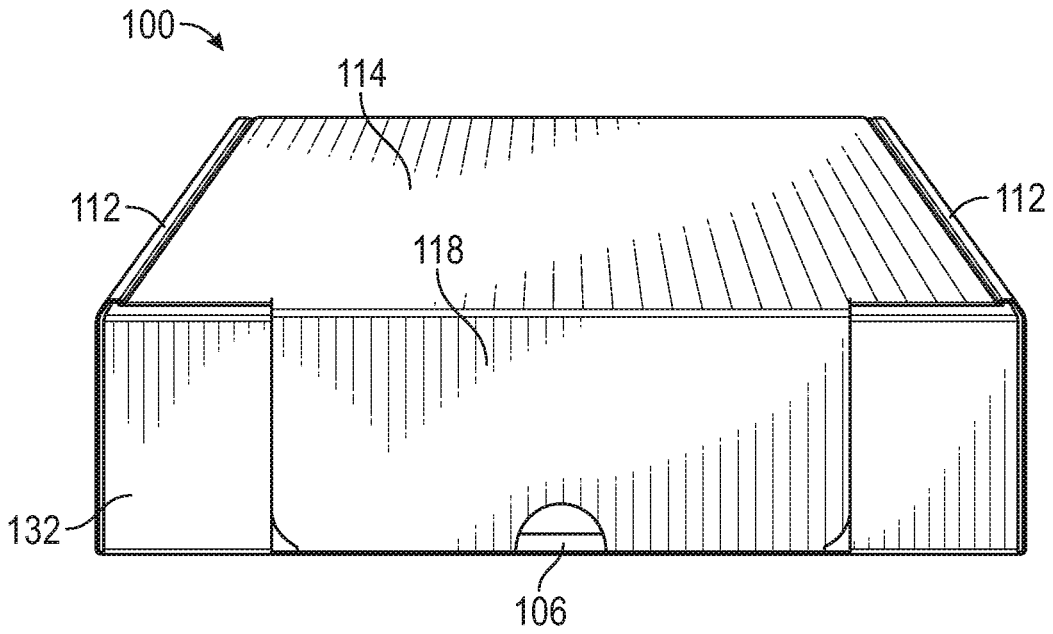
FIG. 10 is a perspective view of the container of FIG. 1, showing the container in a reclosed configuration.

FIG. 2 shows the container 100 in a partially folded configuration. This configuration can be referred to as an open configuration or an initially open configuration. From the open configuration, the container 100 can be further folded to a closed configuration, as shown in FIG. 5. In the closed configuration, the container 100 locks and cannot be reopened without tearing a portion of the container (see, e.g., FIGS. 7-9). These features can, for example, provide securing and irreversible tamper evidence to a recipient of the container 100. If the container 100 is reopened opened, it will be self-evident and/or readily apparent to the recipient. Once reopened, the recipient can access the contents of the container 100. The container 100 can then be reclosed in an unlocked configuration, as shown in FIG. 10. The reclosed configuration can be used for storage, product return, and/or display. Additional details are provided below.

As shown in FIG. 2, the container 100 can comprise two main components: a main body portion 102 and a lid portion 104. The main body 102 can comprise a bottom panel 106, two side walls 108, a back panel 110, and a front wall 112. The main body 102 of the container 100 can comprise an internal cavity which can be used, for example, as a repository for holding goods. The lid 104 can comprise a top panel 114, two side panels 116, a front flap 118, and a locking tab 120. The lid 104 can pivot relative to the main body 102 and can thus be opened (FIG. 2) and closed (FIGS. 5 and 10), as further explained below. As such, the lid 104 of the container 100 can be used, for example, to cover the opening of the main body 102 and to secure the goods within the container 100.

Referring again to FIG. 1, each of the side walls 108 of the main body 102 can comprise a first panel 122, a second panel 124, and two third panels 126. In the assembled configuration, the first panel 122 defines an exterior side of the side wall 108, and the second panel 124 defines an interior side of the side wall 108, and the third panels 126 are disposed between the first panel 122 and the second panel 124. In some embodiments, the second panel 124 of the side wall 108 can comprise a tab 128 configured to mate with a corresponding opening 130 on the bottom panel 106, which can help retain the side wall 108 in the assembled configuration (see FIG. 2).

Referring still to FIG. 1, the front wall 112 can comprise an outer panel 132, an inner panel 134, and an intermediate panel 136. When assembled, the outer panel 132 defines an exterior side of the front wall 112, the inner panel 134 defines an interior side of the front wall 112, and the intermediate panel 136 is disposed between the outer panel 132 and the inner panel 134.

As shown, the outer panel 132 of the front wall 112 can comprise an unlocking tab 138 defined by the perforation lines 140 at the sides of the unlocking tab 138 and by a slot 142 at the top of the unlocking tab 138. The unlocking tab 138 can be torn along the perforation lines 140 such that the unlocking tab 138 pivots relative to the other portions of the outer panel 132. In some embodiments, the unlocking tab 138 can comprise a notch 144. The notch 144 can, for example, make it easier to grasp and pivot the unlocking tab 138 relative to the other portions of the outer panel 132. In other embodiments, the outer panel 132 can be formed without the notch 144.

The intermediate panel 136 of the front wall 112 can comprise a receptacle 146. The receptacle 146 of the intermediate panel 136 can be configured to mate with the locking tab 120 of the lid 104 to secure the lid in the closed configuration. The interaction of the locking tab 120 of the lid 104 and the receptacle 146 of the intermediate panel 136 is further described below.

Figure 3:
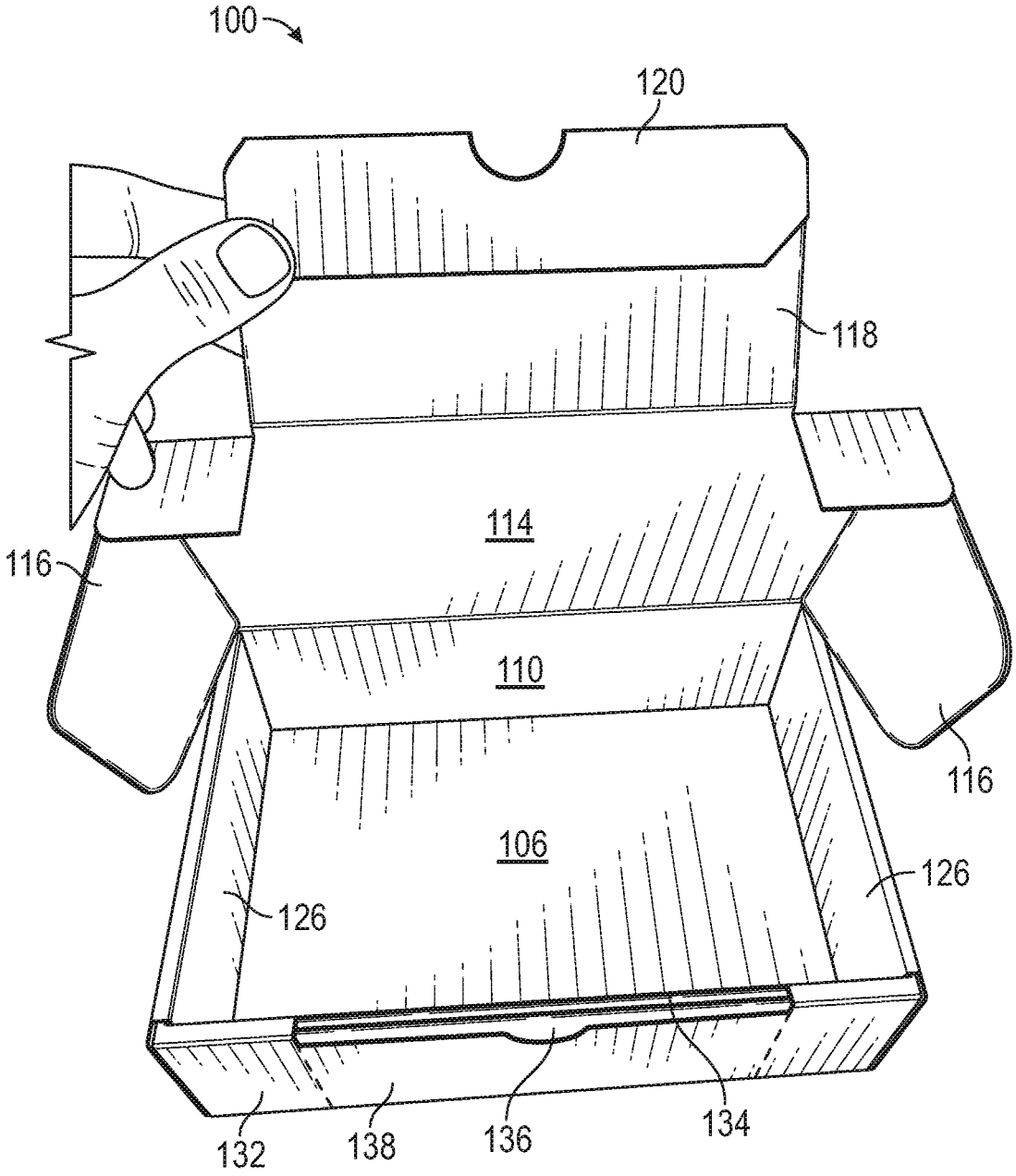
FIG. 3 is a perspective view of the container of FIG. 1, showing the container moving from the initial open configuration towards a closed configuration.
Figure 4:
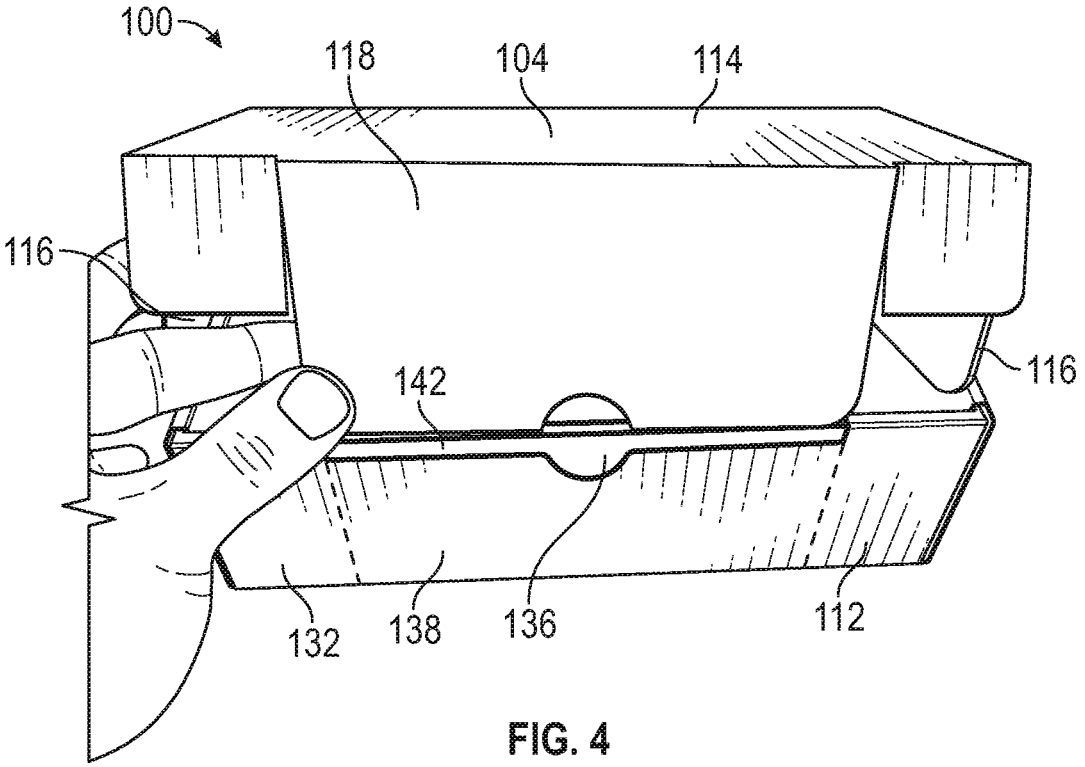
FIG. 4 is a perspective view of the container of FIG. 1, showing the container moving from the initial open configuration further towards the closed configuration.

Exemplary methods of closing, locking, unlocking, and reclosing the container 100 will now be described in turn. With the container in an initial open configuration (see FIG. 3), the lid 104 of the container can be closed. This can be accomplished, for example, by folding the side panels 116 of the lid 104 inward by about 90 degrees such that the side panels 116 are disposed on the interior of the main body 102 (e.g., adjacent to the third panels 126 of the side walls 108), as shown in FIG. 4. The locking tab 120 of the lid 104 can be folded about 180 degrees relative to the front flap 118 of the lid such that the locking tab 120 is disposed on and partially overlaps with the interior side of the front flap 118, as shown in FIG. 3. With the locking tab 120 folded over, the front flap 118 and the locking tab 120 can be inserted into the front wall 112 of the main body 102. This can be performed by inserting the front flap 118 and the locking tab 120 into the slot 142 of the front wall 112 between the outer panel 132 and the intermediate panel 136. As the front flap 118 and the locking tab 120 of the lid 104 slide through the slot 142 of the front wall 112, the unlocking tab 138 of the outer panel 132 and an upper portion 148 (see FIG. 8) of the intermediate panel 136 can retain the locking tab 120 in the approximately 180-degree folded configuration relative to the front flap 118. When the lid 104 is fully closed (see, e.g., FIG. 5), the locking tab 120 of the lid 104 aligns with the receptacle 146 of the intermediate panel 136. Due to the bias of the locking tab 120 to lesser folded configuration (i.e., less than 180 degrees), the locking tab 120 "springs" into the receptacle 146 of the intermediate panel 136. This can, at least in some instances, create a sensory indication (e.g., an audible and/or tactile "click"). The sensory indication can confirm to the user that the box is fully closed.

When the lid 104 fully closes for the first time as shown in FIG. 5, the lid 104 automatically locks relative to the main body 102 such that it cannot be reopened by withdrawing the front flap 118 and locking tab 120 from the slot 142. This is because the locking tab 120 of the lid 104 is disposed and secured within the receptacle 146 of the intermediate panel 136. Thus, in addition to the auto-locking feature, another advantage of the container is that it can be closed and locked without the use of adhesive, tape, fasteners, and/or other sealing means.

In the locked configuration, the locking tab 120 of the lid 104 and the intermediate panel 136 of the main body 102 are co-planar (i.e., "flush") or at least substantially co-planar. As such, one or more first edge surfaces of the locking tab 120 can engage one or more second edge surfaces of the intermediate panel 136 defining a portion of the receptacle 146 to restrict relative movement between the locking tab 120 and the intermediate panel 136. This locks the lid 104 in the closed configuration.

In the illustrated embodiment, the locking tab 120 has three first edge surfaces 150*a*, 150*b*, 150*c*, 150*d*, and 150*e* (generally or collectively, "the first edge surfaces 150"), and the intermediate panel 136 has three second edge surfaces 152*a*, 152*b*, 152*c*, 152*d*, and 152*e* (generally or collectively, "the second edge surfaces 152"). In other embodiments, the locking tab 120 and/or the intermediate panel 136 can comprise less or more edge surfaces.

The first and second edge surfaces 150, 152 engage with each other to restrict various types of relative motion between the locking tab 120 (and thus the lid 104) and the intermediate panel 136 (and thus the main body 102). For example, engagement between the first edge surfaces 150*a* and 150*e* of the locking tab 120 and the respective second edge surfaces 152*a* and 152*e* of the intermediate panel 136 restrict lateral (e.g., side-to-side) movement of the lid 104 relative to the main body 102. Engagement between the first edge surfaces 150*b* and 150*d* of the locking tab 120 and the respective second edge surfaces 152*b* and 152*d* of the intermediate panel 136 restrict lateral and vertical (e.g., upward) movement of the lid 104 relative to the main body 102. Engagement between the first edge surface 150*c* of the locking tab 120 and the respective second edge surface 152*c* of the intermediate panel 136 restricts vertical movement of the lid 104 relative to the main body 102. In this manner, the engagement between locking tab 120 and the intermediate panel 136 locks the lid 104 in the closed configuration.

The co-planar frictional engagement of the locking tab 120 and the intermediate panel 136 provides a significantly stronger and more secure locking closure than prior frictional locking containers. This is because the disclosed co-planar friction engagement has an end-to-end orientation in which the material is stronger than other orientations. Stated another way, when someone is attempting to open the lid 104 from the locked configuration, the forces exerted on the locking tab 120 are in the same direction (i.e., vertical) as the longitudinal axes of the corrugations of the locking tab 120 and the intermediate panel 136. Also, the locking features of the container 100 have a large surface area along which the locking tab 120 and the intermediate panel 136 abut. For example, when attempting to open the lid 104 from the locked configuration, the first edge surfaces 150*b*, 150*c*, and 150*d* of the locking tab 120 abut with the second edge surfaces 152*b*, 152*c*, and 152*d* of the intermediate panel 136, respectively. In addition, the outer panel 132 and the inner panel 134 also support the locking tab 120 and the intermediate panel 136, which can, for example, prevent buckling. As a result, the container 100 can, for example, provide improved strength and thus greater security than typical boxes.

From the locked configuration (e.g., FIG. 5), the container 100 can be unlocked and opened by pivoting the unlocking tab 138 of the outer panel 132 outwardly away from the locking tab 120 of the lid 104. The unlocking tab 138 cannot be pivoted in this manner, however, without tearing the unlocking tab 138 from the outer panel 132 along the perforation lines 140. Therefore, a sealed (i.e., non-torn) unlocking tab 138 can provide assurance to a recipient that the container has not been opened and/or tampered with after it was initially closed (e.g., by a manufacturer, distributer, retailer, etc.). Also, a torn unlocking tab 138 can, for example, alert a recipient that the container 100 has been opened and/or tampered with (e.g., by an intervening distributer, retailer, etc.). Thus, the container 100 can, for example, provide irreversible evidence of tampering to a recipient.

Figure 6:
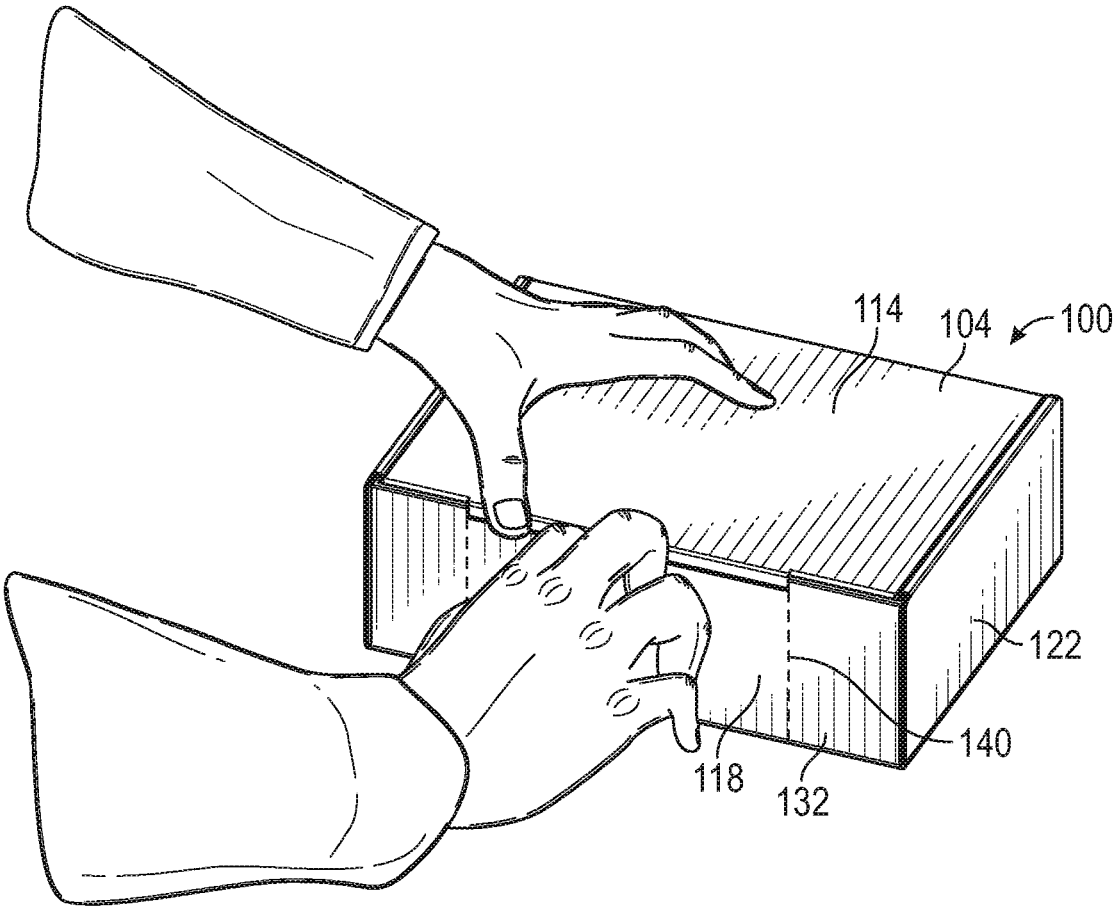
FIG. 6 is a perspective view of the container of FIG. 1, showing a user beginning to open the container from the closed and locked configuration.

FIG. 6 shows a user grasping the unlocking tab 138 of the outer panel. In some embodiments, the unlocking tab 138 can comprise a grasping element 154 (e.g., a cut-out) configured to facilitate grasping. As the user pulls on the unlocking tab 138, the unlocking tab tears away from the outer panel 132 along the perforation lines 140. This allows the unlocking tab 138 to pivot outwardly away from outer panel 132 to the open position shown in FIG. 7. In the illustrated embodiment, the perforation lines 140 are not disposed along any of the edge surfaces of the container 100 (i.e., the edges defining the container). This can, for example, reduce the likelihood that the unlocking tab 138 will be inadvertently opened during shipping and handling.

When the unlocking tab 138 is in the open position, the locking tab 120 of the lid can be moved relative to the receptacle 146 of the intermediate panel 136, which unlocks the lid 104 relative to the main body 102. In some instances, the locking tab 120 can at least partially "pop" out of the receptacle 146 as the unlocking tab 138 is opened due to bias of the locking tab 120 to the unfolded configuration. The lid 104 can be moved from the unlocked configuration (see, e.g., FIG. 7) to an opened (or reopened) configuration by lifting the front flap 118 upwardly (see, e.g., FIGS. 8-9).

The container 100 can also be reclosed after the initial opening. In the reclosed configuration, the container does not automatically relock. Nevertheless, the reclosed configuration can be used, for example, for storage, returns, and/or be reused. This can be accomplished, for example, by completely removing (e.g., by tearing or cutting) the unlocking tab 138 from the container 100. In some embodiments, the unlocking tab 138 can have perforation to facilitate its removal from the container 100. With the unlocking tab 138 removed, the locking tab 120 of the lid 104 can be folded at about 90 degrees relative to the front flap 118, and the locking tab 120 can be inserted into a groove 156 (FIG. 8) that extends between the inner panel 134 and the bottom panel 106, as shown in FIG. 10.

In view of the many possible embodiments to which the principles of the disclosure may be applied, it should be recognized that the illustrated embodiments are only preferred examples and should not be taken as limiting the scope of the claims. Rather, the scope of the claimed subject matter is defined by the following claims and their equivalents.

The invention claimed is:

1. A container comprising:

a main body portion comprising a plurality of panels including an inner panel, an intermediate panel, and an outer panel, wherein the intermediate panel is disposed between the inner panel and the outer panel, wherein the inner panel, the intermediate panel, and the outer panel form a receptacle, and wherein the outer panel comprises a perforated tab; and a lid portion pivotably coupled to the main body portion, wherein the lid portion comprises a locking tab, wherein the container can be locked in a closed configuration by inserting the locking tab of the lid portion into the receptacle of the main body portion, wherein the perforated tab of the main body portion retains the locking tab of the lid portion within the receptacle of the main body portion when the perforated tab is in a first position relative to the outer panel, and wherein the container can be unlocked by moving the perforated tab from the first position to a second position relative to the outer panel and by removing the locking tab of the lid portion from the receptacle of the main body portion.

2. The container of claim 1, wherein the locking tab and the intermediate panel are at least substantially coplanar when the container is in the closed configuration.

3. The container of claim 1, wherein the locking tab comprises one or more first edge surfaces, wherein the intermediate panel comprises one or more second edge surfaces partially defining the receptacle, and wherein the one or more first edge surfaces engage with the one or more second edge surfaces to retain the container in the closed configuration.

4. The container of claim 3, wherein the one or more first edge surfaces abut with the one or more second edge surfaces.

5. The container of claim 1, wherein the locking tab is pivotably coupled to a flap of the lid portion, and wherein the locking tab overlaps the flap when the container is locked in the closed configuration.

6. The container of claim 5, wherein when the perforated tab is moved from the first position to the second position, the locking tab pivots away from the flap such that the locking tab and the flap do not overlap.

7. The container of claim 1, wherein the main body portion and the lid portion are integrally formed.

8. The container of claim 1, wherein the container comprises cardboard.

9. The container of claim 1, wherein the container can be locked in the closed configuration without the use of adhesive.

10. A box comprising:

a main body portion comprising a first panel, a second panel, and a third panel, wherein the first panel is disposed between the second panel and the third panel and comprises an opening formed therein, and wherein the second panel comprises a perforated tab; and a lid portion pivotably coupled to the main body portion, wherein the lid portion comprises a locking tab, wherein the box can be locked in a closed configuration by inserting the locking tab of the lid portion into the opening of the first panel such that the locking tab is flush with the first panel, wherein the perforated tab of the second panel retains the locking tab of the lid portion within the opening of the first panel when the perforated tab is in a first position relative to the second panel, and wherein the box can be unlocked by moving the perforated tab from the first position to a second position relative to the second panel, and wherein moving the perforated tab to the second position can provide irreversible evidence of tampering.

11. The box of claim 10, wherein moving the perforated tab from the first position to the second position relative to the second panel comprises tearing the perforated tab along one or more perforation lines, wherein the torn perforated tab provides the irreversible evidence of tampering.

12. The box of claim 10, wherein the box comprises cardboard.

13. The box of claim 10, wherein the box can be locked in the closed configuration without the use of adhesive, tape, fasteners, or other sealing means.

14. A container comprising:

a main body portion comprising a plurality of panels forming an internal cavity for holding goods and a closure receptacle, wherein the plurality of panels includes a first panel and a second panel, wherein the first panel comprises a perforated tab; and a lid portion pivotably coupled to the main body portion, wherein the lid portion comprises a locking tab and a flap, wherein the locking tab is pivotably coupled to the flap, wherein the container can be locked in a closed configuration by inserting the locking tab of the lid portion into the closure receptacle of the main body portion, wherein the locking tab of the lid portion overlaps the flap of the lid portion when the container is locked in the closed configuration, wherein the perforated tab of the main body portion retains the locking tab of the lid portion within the closure receptacle of the main body portion when the perforated tab is in a first position relative to the second panel, and wherein the container can be unlocked by moving the perforated tab from the first position to a second position relative to the second panel and by removing the locking tab of the lid portion from the closure receptacle of the main body portion.

15. The container of claim 14, wherein when the perforated tab is moved from the first position to the second position, the locking tab pivots away from the flap such that the locking tab and the flap do not overlap.

16. The container of claim 14, wherein the main body portion and the lid portion are integrally formed.

17. The container of claim 14, wherein the closure receptacle is defined by the first panel, the second panel, and a third panel, and wherein the third panel is disposed between the first panel and the second panel.

18. The container of claim 17, wherein the third panel comprises an opening formed therein, and wherein the locking tab mates with the opening of the third panel when the container is locked in the closed configuration.

19. The container of claim 17, wherein the locking tab is at least substantially co-planar with the third panel when the container is locked in the closed configuration.

20. The container of claim 14, wherein the main body portion further comprises a groove configured to receive the locking tab of the lid portion to re-close the container after the container is unlocked.

* * * * *